US009932140B2

(12) United States Patent
Lindley et al.

(10) Patent No.: US 9,932,140 B2
(45) Date of Patent: Apr. 3, 2018

(54) STABILIZED LOAD TRAY

(71) Applicants: David Lindley, Oklahoma City, OK (US); Dow Global Technologies LLC, Midland, MI (US)

(72) Inventors: David Lindley, Oklahoma City, OK (US); William B Bellefontaine, Baton Rouge, LA (US)

(73) Assignees: David Lindley, Oklahoma City, OK (US); Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/438,500

(22) PCT Filed: Oct. 24, 2013

(86) PCT No.: PCT/US2013/066670

§ 371 (c)(1),
(2) Date: Apr. 24, 2015

(87) PCT Pub. No.: WO2014/066673

PCT Pub. Date: May 1, 2014

(65) Prior Publication Data

US 2015/0284129 A1 Oct. 8, 2015

Related U.S. Application Data

(60) Provisional application No. 61/718,619, filed on Oct. 25, 2012, provisional application No. 61/890,666, filed on Oct. 14, 2013.

(51) Int. Cl.

| | |
|---|---|
| ***B65D 1/34*** | (2006.01) |
| ***B65D 19/00*** | (2006.01) |
| ***B65D 71/00*** | (2006.01) |

(52) U.S. Cl.
CPC ..... *B65D 1/34* (2013.01); *B65D 19/0034* (2013.01); *B65D 19/0036* (2013.01);
(Continued)

(58) Field of Classification Search
CPC ..... B65D 25/14; B65D 1/34; B65D 19/0034; B65D 19/0036; B65D 19/0038; B65D 19/0096
See application file for complete search history.

(56) References Cited

U.S. PATENT DOCUMENTS 2,615,661 A * 10/1952 Cushman ..... B65D 19/004 108/52.1
3,101,864 A * 8/1963 Glickman ..... B65D 1/34 206/557

(Continued)

FOREIGN PATENT DOCUMENTS

EP 2377769 A1 10/2011
GB 2240326 A 7/1991

OTHER PUBLICATIONS

International Search Report and Written Opinion issued in connection with PCT Application No. PCT/US13/66670 dated Oct. 24, 2013.

(Continued)

*Primary Examiner* — Anthony Stashick
*Assistant Examiner* — James Way
(74) *Attorney, Agent, or Firm* — Crowe & Dunlevy, P.C.

(57) ABSTRACT

The invention provides a stabilized load tray for supporting a load stack, the stabilized load tray comprising:
a horizontal floor;
vertical side walls connected to the floor;
a top connected to the side walls; and
(Continued)

a deployable lip connected to the top, wherein the deployable lip can be folded from a substantially horizontal position to a substantially vertical position adjacent the load stack.

24 Claims, 9 Drawing Sheets

(52) U.S. Cl.
CPC ..... *B65D 19/0038* (2013.01); *B65D 71/0096* (2013.01); *B65D 2519/00034* (2013.01); *B65D 2519/00069* (2013.01); *B65D 2519/0087* (2013.01); *B65D 2519/0094* (2013.01); *B65D 2519/00268* (2013.01); *B65D 2519/00288* (2013.01); *B65D 2519/00323* (2013.01); *B65D 2519/00333* (2013.01); *B65D 2519/00343* (2013.01); *B65D 2519/00348* (2013.01); *B65D 2519/00412* (2013.01); *B65D 2519/00815* (2013.01); *B65D 2571/00018* (2013.01)

(56) References Cited

U.S. PATENT DOCUMENTS 3,480,196 A * 11/1969 Simas ..... B65D 19/20 108/51.3
3,790,021 A * 2/1974 Bailey ..... B65D 25/14 220/495.03
3,874,546 A 4/1975 Sanders et al.
3,944,070 A * 3/1976 Cardwell ..... B65D 19/004 108/53.1
4,000,704 A * 1/1977 Griffin, Jr. ..... B65D 19/004 108/53.1
4,339,040 A 7/1982 Peil
5,036,976 A * 8/1991 Sechler ..... B65D 19/004 108/53.1
5,144,897 A 9/1992 Avery
5,176,090 A * 1/1993 Roberts ..... B65D 19/0026 108/51.3
5,483,875 A 1/1996 Turecek et al.
5,970,886 A 10/1999 Knio
6,311,628 B1 * 11/2001 Smith ..... B65D 19/38 108/55.1
6,739,270 B1 * 5/2004 Sewell ..... B65D 19/0012 108/51.3
8,146,515 B2 * 4/2012 Trickett ..... B65D 19/36 108/51.11
2006/0260976 A1 11/2006 Apps
2010/0251940 A1 10/2010 Jones

OTHER PUBLICATIONS

Supplementary European Search Report; Date of Completion: Jul. 21, 2016 in connection with EP 13 84 8251.

* cited by examiner

STABILIZED LOAD TRAY

REFERENCE TO RELATED APPLICATIONS

This application claims the benefit of U.S. Provisional Patent Application 61/718,619, filed Oct. 25, 2012, and U.S. Provisional Patent Application 61/890,666, filed Oct. 14, 2013, both of which are incorporated herein by reference.

FIELD OF THE INVENTION

The present invention relates generally to the improvement of load-handling trays. More particularly, the present invention relates to a functionally improved and more economical load-handling tray.

BACKGROUND OF THE INVENTION

Materials handling pallets and trays are commonly used to transport a wide variety of products in bulk quantities. Pallets are typically rectangular-shaped boxes that are configured to support loads without significant deformation or structural failure. Although many pallets are constructed from wood, plastic pallets are becoming increasingly popular. Plastic pallets can support heavier loads, are impervious to rot and infestation and are less flammable than conventional wooden pallets.

Most traditional pallets incorporate a number of top slats supported by a number of risers that are in turn, supported by a base. In this way, the weight of the load is transferred from the top slats to the base through the risers. The risers are usually configured to permit the introduction of the arms of a forklift or pallet jack below the pallet top. While being lifted or moved, the weight of the load is transferred directly from the top to the arms of the forklift or jack.

Although widely accepted, traditional pallets suffer two significant shortcomings. First, without modifications, traditional pallets offer very little lateral support for stacked loads. For loads that include flexible or semi-rigid containers, the lack of lateral support can cause the load to slump, fall or slide from the pallet.

Second, traditional pallet designs require the use of forklifts to raise, lower and move the palleted load. In many locations, the absence of a trailer-high loading dock frustrates the ability to position a forklift or truck adjacent a pallet located within the interior of a trailer. In those locations, workers typically wrap a chain around the base of the pallet or load and then pull the pallet to the edge of the trailer, where it can be unloaded from the trailer by a forklift positioned on the ground. Traditional pallets are not designed to withstand the stress, abrasion, uneven twisting torque and jerking of being pulled along the floor of a trailer by a chain. When moved in this manner, traditional pallets often fail, causing the stacked load to fall.

Thus, there continues to be a need for a safer, more stable pallet. It is to these and other deficiencies in the prior art that the present invention is directed.

SUMMARY OF PREFERRED EMBODIMENTS

An inventive stabilized load tray may comprise two or more embodiments, as described herein.

The invention provides a stabilized load tray for supporting a load stack, the stabilized load tray comprising:

a horizontal floor;

vertical side walls connected to the floor;

a top connected to the side walls; and a deployable lip connected to the top, wherein the deployable lip can be folded from a substantially horizontal position to a substantially vertical position adjacent the load stack.

In one embodiment, the stabilized load tray comprises a plurality of bolsters extending from the side walls.

In one embodiment, the deployable lip comprises a unitary lip that extends around the periphery of the top of the stabilized load tray. In another embodiment, the deployable lip comprises a series of independent rails connected to the top of the stabilized load tray.

In one embodiment, the inner length of the tray (ILT) is greater than, or equal to, the inner width of the tray (IWT), and wherein the inner depth of the tray (IDT) is less than 0.4×ILT, further less than 0.3×ILT, further less than 0.2×ILT; and the lip extends from at least two side walls of the tray, and wherein the width of the lip (Wlip) is greater than, or equal to, 0.2×IDT, further greater than, or equal to, 0.3×IDT, further greater than, or equal to, 0.5×IDT. The tray is preferably formed from a composition comprising at least one polymer.

In a further embodiment, the polymer is an olefin-based polymer, and further an ethylene-based polymer.

The ILT is measure across the top of the tray, from the edge of one vertical wall to the edge of the opposite vertical wall.

The IWT is measure across the top of the tray, from the edge of one vertical wall to the edge of the opposite vertical wall.

The IDT is measured from the base floor (horizontal floor) of the tray to the top of the tray.

The Wlip is measured from the top edge of a vertical wall to the end of the lip.

In one embodiment, the inner surface area of the floor is greater than, or equal to, 5,000 $cm^2$, further greater than, or equal to, 8,000 $cm^2$, further greater than, or equal to, 10,000 $cm^2$.

In one embodiment, the ILT is from 60 cm to 300 cm, further from 80 cm to 250 cm, and further from 100 cm to 200 cm.

In one embodiment, the IWT is from 40 cm to 250 cm, further from 60 cm to 220 cm, and further from 80 cm to 180 cm.

In one embodiment, the IDT is from 7 cm to 100 cm, further from 10 cm to 80 cm, and further from 12 cm to 50 cm.

In one embodiment, the Wlip is from 4 cm to 24 cm, further from 6 to 20 cm, and further from 8 cm to 16 cm.

In one embodiment, the tray has a uniform thickness that is greater than, or equal to, 0.00025×Wlip, further greater than, or equal to, 0.00500×Wlip, further greater than, or equal to, 0.01000×Wlip.

In one embodiment, the stabilized load tray comprises a pillar extending upward from the horizontal floor.

In one embodiment, the outer height of the pillar (OHpillar) is from 0.80 to 1.20 times the IDT, further from 0.90 to 1.10 times the IDT. The OHpillar is measured from the base floor (horizontal floor) of the tray to the top of the pillar.

In one embodiment, the pillar is located midway along the ILT.

In one embodiment, the pillar is located midway along the IWT.

In one embodiment, the outer length of the pillar (OLpillar) is greater than, or equal to, 0.20×IWT. The OLpillar is measure across the top of the pillar, from one edge to the opposite edge. The OLpillar is greater than, or equal to, the OWpillar.

In one embodiment, the outer width of the pillar (OWpillar) is greater than, or equal to, 0.10×ILT. The OWpillar is measure across the top of the pillar, from one edge to the opposite edge.

In one embodiment, the outer length of the pillar runs parallel to the width of the tray.

In one embodiment, the OLpillar is from 8 cm to 50 cm, further from 12 to 45 cm, and further from 18 cm to 36 cm.

In one embodiment, the OWpillar is from 6 cm to 30 cm, further from 8 cm to 15 cm, and further from 11 cm to 20 cm.

In one embodiment, the OHpillar is from 19 cm to 144 cm, further from 25 cm to 82 cm, and further from 35 cm to 64 cm.

A pillar may comprise a combination of two or more embodiments as described herein.

In one embodiment, the tray comprises at least two bolsters. In a further embodiment, the two bolsters are located at opposite side walls of the tray. In a preferred embodiment, each bolster extends at a distance of greater than, or equal to, 0.035×IWT, from a side wall. In another preferred embodiment, the outer height of each bolster is equal to the IDT. The outer height of a bolster is measured from the base floor (horizontal floor) of the tray to the top of the bolster.

In one embodiment, the height of the bolster is from 19 cm to 144 cm, further from 25 cm to 82 cm, and further from 35 cm to 64 cm.

A bolster may comprise a combination of two or more embodiments as described herein.

In one embodiment, the lip is bent upward at an angle greater than, or equal to, 0.5 degree, relative to the unextended position of the lip. In a further embodiment, the lip is bent at a distance from 0.40 to 0.60 times the Wlip, measured from the outer edge of the lip.

In one embodiment, the lip is bent upward at an angle greater than, or equal to, 1 degree, relative to the unextended position of the lip. In a further embodiment, the lip is bent at a distance from 0.40 to 0.60 times the Wlip, measured from the outer edge of the lip.

In one embodiment, the lip is bent upward at an angle greater than, or equal to, 5 degree, relative to the unextended position of the lip. In a further embodiment, the lip is bent at a distance from 0.40 to 0.60 times the Wlip, measured from the outer edge of the lip.

In one embodiment, the lip is bent upward at an angle greater than, or equal to, 20 degree, relative to the unextended position of the lip. In a further embodiment, the lip is bent at a distance from 0.40 to 0.60 times the Wlip, measured from the outer edge of the lip.

In one embodiment, the lip is bent upward at an angle greater than, or equal to, 50 degree, relative to the unextended position of the lip. In a further embodiment, the lip is bent at a distance from 0.40 to 0.60 times the Wlip, measured from the outer edge of the lip.

In one embodiment, the tray comprises at least two ridges located at opposite ends of the floor, and wherein each ridge independently comprises the following dimensions: outer length (OLridge), outer width (OWridge) and outer height (OHridge); and wherein the OHridge is less than, or equal to, 0.5×IDT. The (OLridge) is measure across the top of the ridge, from one edge to the opposite edge. The OLridge is greater than, or equal to, the OWridge. The OWridge is measure across the top of the ridge, from one edge to the opposite edge. The OHridge is measured from the base floor (horizontal floor) of the tray to the top of the ridge.

In one embodiment, the OWridge of each ridge is independently equal to the OWpillar. In a further embodiment, the OLridge of each ridge runs parallel to the IWT. In a further embodiment, the OHridge of each ridge is independently less than, or equal to, 0.20 IDT.

In one embodiment, the OLridge is from 55 cm to 300 cm, further from 70 cm to 250 cm, and further from 100 cm to 200 cm In one embodiment, the OWridge is from 10 cm to 20 cm, further from 12 cm to 18 cm, and further from 14 cm to 16 cm In one embodiment, the OHridge is from 12 cm to 60 cm, further from 15 cm to 50 cm, and further from 20 cm to 40 cm A ridge may comprise a combination of two or more embodiments as described herein.

In one embodiment, the stabilized load tray further comprises a raised fork tunnel. In a further embodiment, the tray comprises two raised fork tunnels.

In one embodiment, the stabilized load tray further comprises a rail. In a further embodiment, the tray comprises four rails.

The stabilized load tray may comprise a combination of two or more embodiments as described herein.

DESCRIPTION

Figure 1:
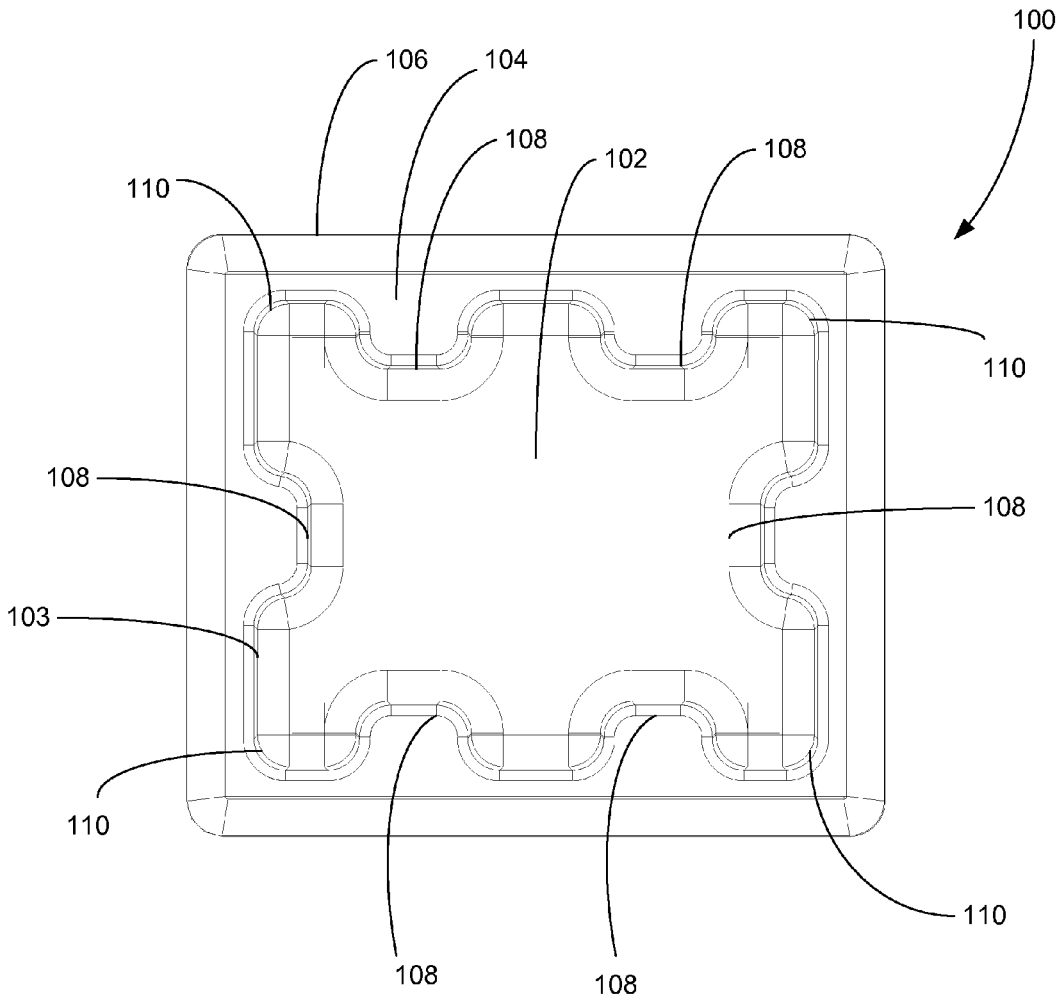
FIG. 1 is a top view of a load tray constructed in accordance with a preferred embodiment of the present invention.
Figure 2:
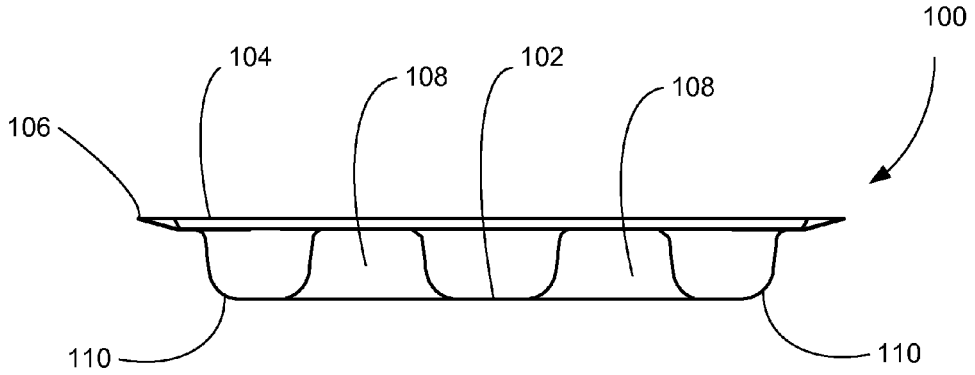
FIG. 2 is a front side elevational view of the load tray of FIG. 1.

Referring to FIGS. 1 and 2, shown therein is a preferred embodiment of a load-handling tray 100. The tray 100 includes a floor 102, side walls 103, a top 104, and a lip 106. The tray 100 further includes bolsters 108 along the side walls 103 that extend from the floor 102 to the top 104. In the presently preferred embodiment, the tray 100 is rectangular and includes two bolsters 108 along the long side of the tray and a single bolster 108 along the short side of the tray 100. The tray 100 further includes rounded corners 110 at the junction between sides of the tray 100.

In a preferred embodiment, the tray 100 is sized and configured to permit the forks of a forklift to pass under the lip 106, in either direction. The dimensions and geometry of the various portions of the tray 100 allow multiple trays 100 to be closely stacked within each other. When nested together, there is very little airspace between the trays 100. This represents a significant improvement over prior art pallets, which cannot be efficiently stacked in storage before use. The use of a solid floor 102 is a significant improvement over the prior art. Traditional pallets with a slatted top do not protect the load from water, insects or other environmental contaminants.

The tray 100 is preferably constructed from a plastic using vacuum forming techniques. Alternatively, the tray 100 can be formed by injection molding or roto-mold techniques. Suitable plastics include high density polyethylene (HDPE), polypropylene (PP), polyethylene (PE), acrylonitrile butadiene styrene (ABS), polycarbonate (PC), polyvinyl chloride (PVC) and high impact polystyrene (HIPS). The tray 100 is highly suited and designed for construction from both virgin and recycled plastic grades where suitable plastics are readily available. The thickness of the tray 100 can be adjusted based on the requirements for a particular application. In presently preferred embodiments, each tray 100 weighs about 4-6 pounds. It will be understood that the material of construction and weight of the tray 100 may vary depending on the intended application, and the materials of construction listed herein are not exclusive of the types of plastics or blends of plastic types that may be used in the construction of the tray 100.

In a particularly preferred embodiment, the plastic used to manufacture the tray 100 includes one or more performance additives. In a first preferred embodiment, a slip additive is used to prevent trays 100 from becoming locked from static, vacuum and suction. Such additives include, but are not limited to, PALMOWAX brand ethylene bis-stearamide (EBS) and PALMOCOL brand alkanolamides available from the Palmamide company. These products are 100% vegetable-based lubricants that provide excellent slip characteristics to facilitate the separation of the nested trays 100. Vegetable-based additives are preferred because they do not include animal products or bi-products.

Other additives include, but are not limited to, for example, stabilizers, such as IRGANOX 1010, which is a highly effective, non-discoloring stabilizer for organic substrates such as plastics, synthetic fibers, elastomers, adhesives, waxes, oils and fats. Stabilizers will help to protect these substrates against thermo-oxidative degradation, and may also serve as an embedded, integral lubricant that facilitates the separation of nested trays 100. In yet another preferred embodiment, the tray 100 can be manufactured with insecticidal, fungicidal and/or herbicidal additives, to discourage the destruction of loads that are susceptible to spoilage and infestation. For example, oil of wintergreen may be provided as an additive to the plastic during manufacturing.

In preferred embodiments, the tray 100 further includes a textured interior surface along the floor 102. The textured surface along the floor 102 further reduces the likelihood that nested trays 100 become locked together during storage. The textured surface also increases the traction between the load bags and the floor 102 of the tray 100. In a presently preferred embodiment, the texture includes dimples, raised ridges, or a random pattern of projections and recesses extending along at least some portion of the floor 102.

Figure 3:
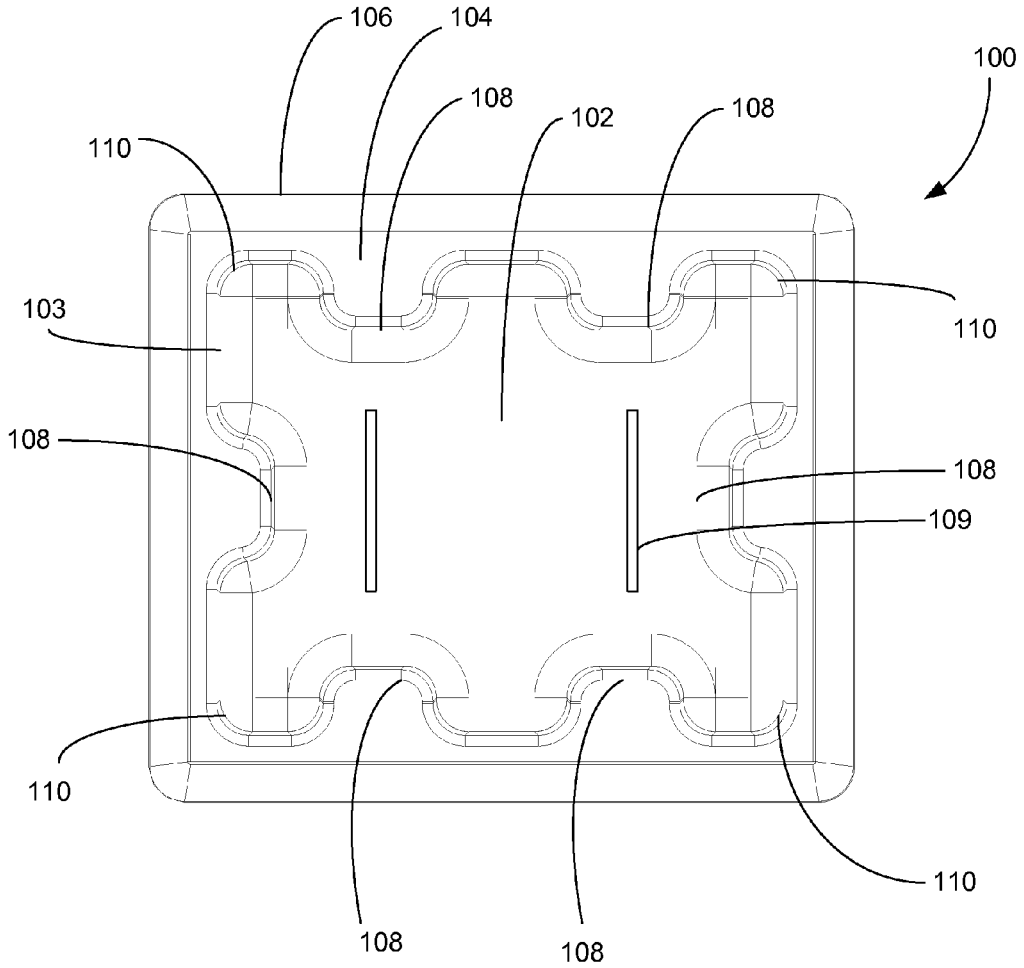
FIG. 3 is a top view of a load tray constructed in accordance with an alternate preferred embodiment of the present invention.

Turning to FIG. 3, shown therein is an alternate preferred embodiment of the tray 100 that includes one or more ridges 109. In addition to, or as an alternative, the textured surface of the floor 102, the tray 100 optionally includes ridges 109 molded into the floor 102 that add strength to a bottom layer of bags 112 stacked within the tray 100. It will be appreciated that the ridges 109 may vary in length, width, height, orientation, number, pattern and shape.

The use of ridges 109 is particularly important for the stabilization of bags 112 that my compress or load unevenly when being stacked on the tray 100. The ridges 109 counteract the asymmetric and unbalanced forces of the stacking to create a bottom layer of bags 112 that is more evenly balanced. This allows the tray 100 to be leveled and sit in a stable, balanced position even when the load is unbalanced or asymmetric in dimension. The greater stability provided by the ridges 109 is particularly significant when multiple trays 100 are stacked on one another and each of the trays includes two or more layers of bags 112.

It is also presently preferred that the tray 100 include a smooth exterior surface along the floor 102. The smooth exterior surface facilitates the use of vacuum-based handling equipment for separating and manipulating the trays 100. In a particularly preferred embodiment, the vacuum-based handling equipment includes robotic machinery that uses pneumatic suction cups, air separation jets or a combination of suction cups and air separation jets to grab and separate a single tray 100 from a stack of nested trays 100. The suction cups adhere to the smooth exterior surface of the tray and the air separation jets encourage the separation of the trays 100 by introducing a positive pressure between adjacent trays 100. In certain applications, it may be useful to complement or replace the air separation jets with vibratory equipment that slightly shakes the nested trays to facilitate separation.

Figure 4:
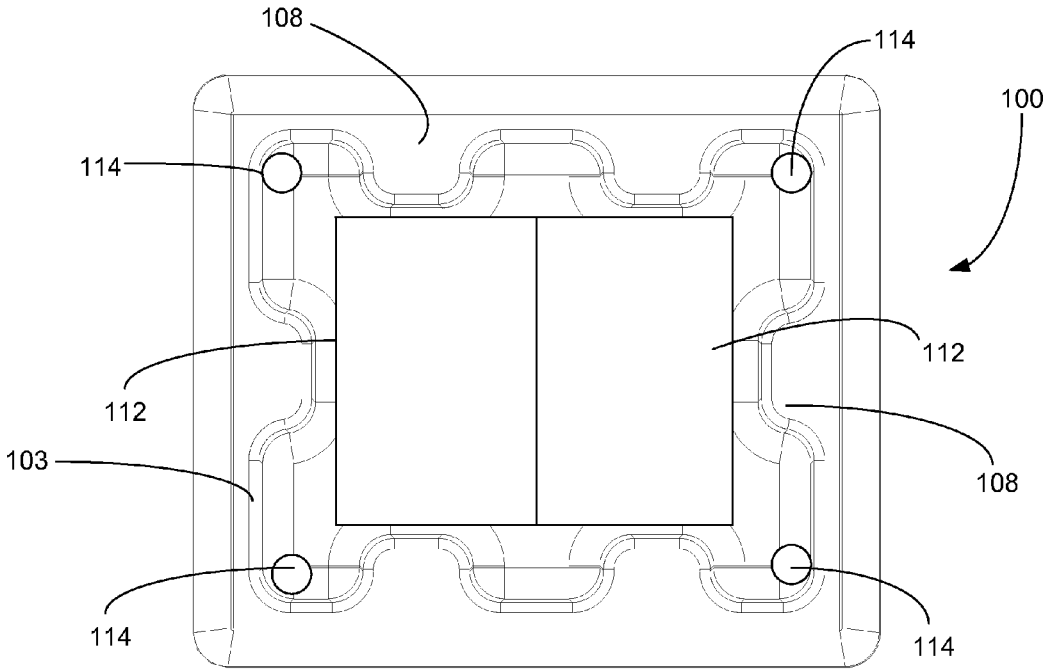
FIG. 4 is a top view of the load tray showing an exemplar placement of two load bags placed on the bottom layer.
Figure 5:
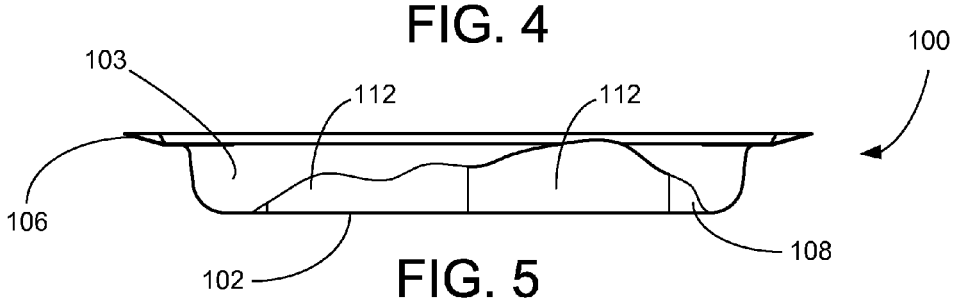
FIG. 5 is a front side elevational, partial cutaway view of the load tray of FIG. 4 showing the elevational view of the two load bags placed on the bottom layer.

Turning to FIGS. 4 and 5, shown therein are top and side views, respectively, of the tray 100 with two load bags 112 positioned as a bottom layer on the floor 102. Ideally, although not so required, the tray 100 and bags 112 are respectively sized such that two bags 112 can be placed side-by-side on the floor 102 between the bolsters 108, with the length of the bags 112 oriented transversely to the longitudinal axis of the tray 100. With this configuration, the bags 112 slightly deform the bolsters 108 as the bags 112 are captured between the bolsters 108. The bags 112 press against the bolsters 112 and add rigidity to the tray 100. The bolsters 108 transfer some of the force from the bag 112 into the side walls 103 of the tray 100. This, in turn, further enhances the rigidity of the side walls 103. The placement of the bolsters 108 within the tray 100 is optimized for the effective transfer of force from the bags 112 to the floor 102, side walls 103 and top 104 to increase the stability and structural integrity of the tray 100.

Figure 6:
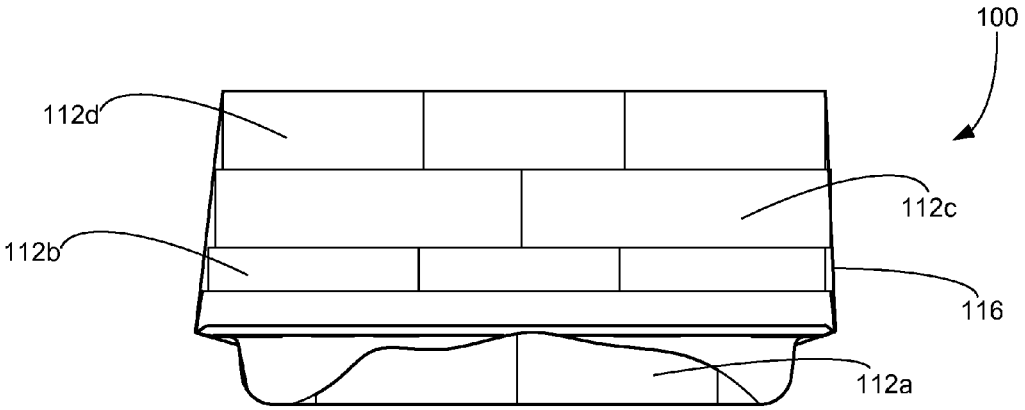
FIG. 6 is a front side elevational, partial cutaway view of the load tray of FIG. 5, showing the elevational view of four layers of stacked load bags, wrapped with a film.

FIG. 6 depicts the placement of four layers of bags 112*a*-112*d* within the tray 100. As additional bags 112 are placed on the load stack, the direction of the bags 112 is preferably alternated from one layer to the next. It will be noted that the second layer of bags 112*b* is preferably aligned with the first layer of bags 112*a* and is supported by the lower layer of bags 112 and the top 104 of the tray 100. Thus, the placement of bags 112*a* within the floor 102 increases the rigidity of the tray 100 and lowers the center of gravity of the load stack placed on the tray 100. Similarly, as bags 112*b*-112*d* are placed over the top 104, the force is transferred into the bolsters 108 and side walls 103 to further increase the rigidity of the tray 100. It will be appreciated and understood that alternative stacking patterns and methods can be employed with equal success and are contemplated as falling within the scope of presently preferred embodiments.

In many applications, it will be desirable to wrap the loaded tray 100 with a suitable film 116 to isolate the load from moisture and increase resistance to spillage. When wrapped or stretched tightly, the film 116 lifts the lip 106 into a deployed position in contact with the bags 112. In this way, the raised lip 106 provides further lateral support for the lower layers of bags 112. Additionally, the raised lip 106 guards the bags 112 from accidental puncture or tearing from forklifts or other machinery. It will also be understood that the lip 106 helps to secure the stretched film 116 on the tray 100.

Figure 2A:
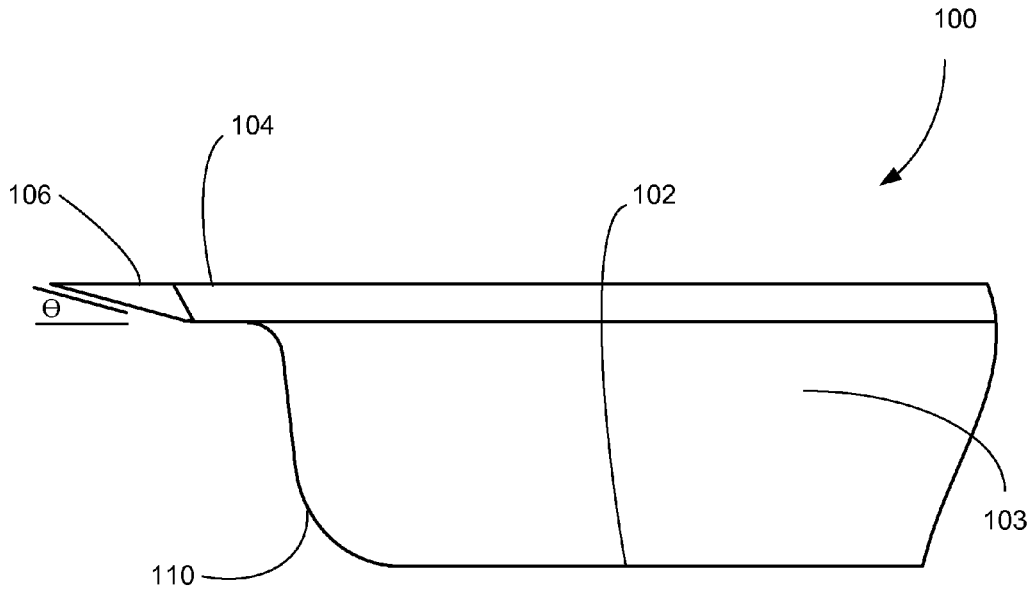
FIG. 2A provides a close-up view of the lip of the tray of FIG. 1 in an initial position.
Figure 2B:
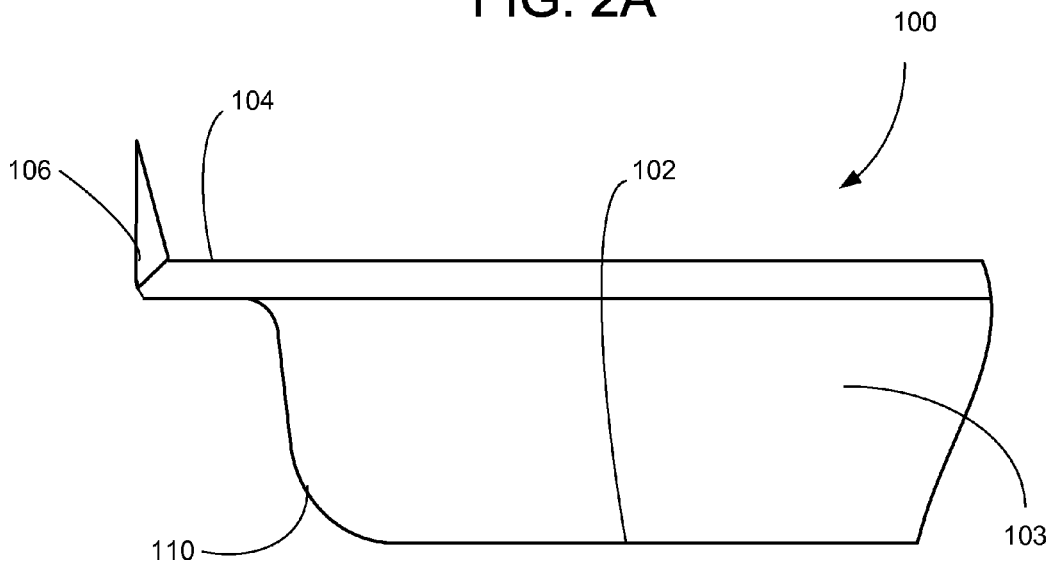
FIG. 2B provides a close-up view of the lip of the tray of FIG. 1 in a deployed position.

The movement of the lip 106 is best illustrated in the close-up views of FIGS. 2A and 2B. As noted in FIG. 2A, the lip 106 is initially formed with a slight upward angle "⊖" When the film 116 is applied over the bottom of the tray 106, the film pulls the lip 106 into a substantially vertical "deployed" position as illustrated in FIG. 2B. In the deployed position illustrated in FIG. 2B, the lip 106 remains in contact with the bags 112 to provide additional lateral support.

It is also noted that the bolsters 108 and corners 110 are also configured to controllably deform when a chain or strap is used to pull the tray 100. By controllably deforming, the bolsters 108 and corners 110 the chain or pull strap is less likely to slip or be pulled under or over the tray 100. In this way, bolsters 108 and corners 110 act as a catch to more securely hold the chain or strap.

Turning back to FIG. 4, shown therein are treatment packages 114. The bolsters 108 and corners 110 cooperatively form voids within the tray 100 that can be used to house the treatment packages 114. In a presently preferred embodiment, the treatment packages 114 include desiccants, pest control devices, fungicides or herbicides. The voids formed within the tray 100 permit the automated placement of these treatment packages 114 within the tray 100 by robotic equipment.

The tray 100 is constructed so that the tines of a standard width fork lift can pick up the tray 100 at four points of directional entry when lifting the tray. The tines can be standard tapering tines and do not require modification to work with the tray 100. The tray 100 is also suitable for lifting by straps where the attachment of the lifting strap loops is available on two sides or all four sides of the tray 100. The ability to easily place lifting straps around the tray 100 facilitates the movement of trays 100 from cargo holds or other storage facilities with limited access.

Figure 7:
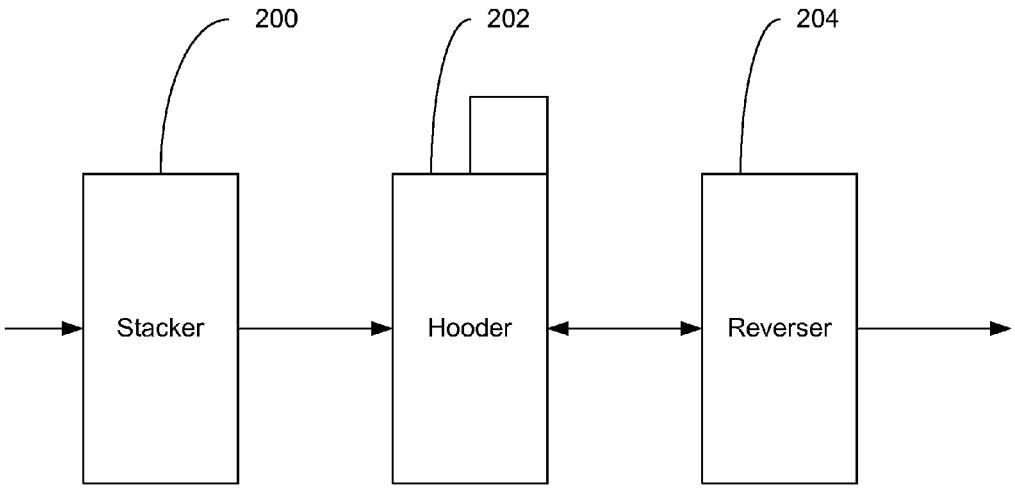
FIG. 7 is a process flow diagram depicting a preferred method of using the load tray of FIG. 1 in a loading, stacking and wrapping operation.

Turning to FIG. 7, shown therein is a process flow diagram for an exemplary method of loading bags 112 onto a tray 100. Bags 112 are automatically and robotically stacked onto a conveyor system at step 200. At step 202, a hooder device removes a tray 100 from a nested storage stack of trays, incorporates any selected treatment packages 114 into the tray 100, and places the tray 100 onto the top of the load stack of bags 112. Next, the hooder 202 stretches a sealing film 116 around the tray 100 and stack of bags 112. The stretched sealing film 116 forces the lip 106 into a deployed position and is retained by the lip 106.

At step 204, the partially enclosed stack of bags 112 is rotated upside-down in a reverser machine 204. The stack of bags 112 is then returned to the hooder 202 with the tray 100 on the bottom of the stack. The hooder 202 then completes the closure cycle by extending a second layer of sealing film 116 from the top of the stack to the tray 100. Once completely sealed, the stack can be taken by forklift or truck to shipping or storage containers. It will be appreciated that the stacking and sealing process depicted in FIG. 7 is merely exemplary and that the trays 100 will find utility in other loading applications.

Figure 8:
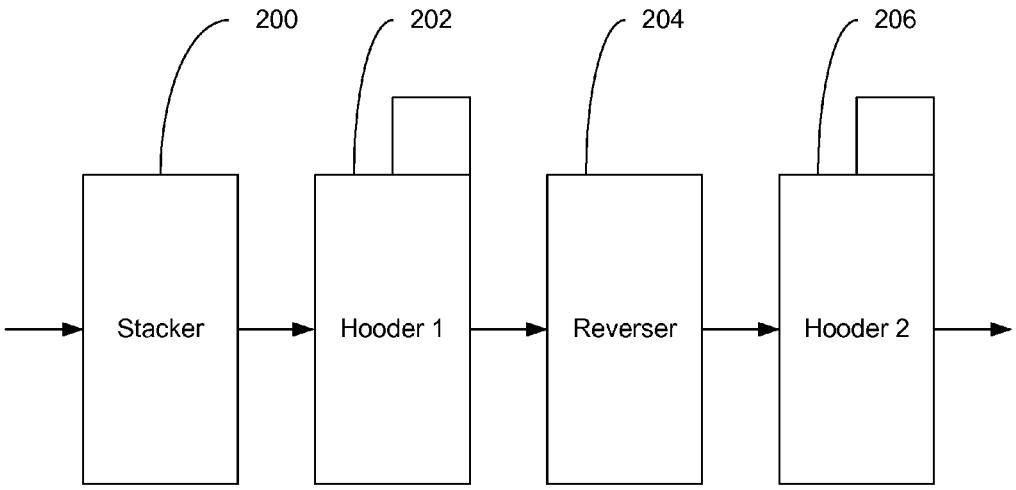
FIG. 8 is a process flow diagram depicting an alternate preferred method of using the load tray of FIG. 1 in a loading, stacking and wrapping operation.

Turning now to FIG. 8, shown therein is an alternate method of loading bags 112 onto a tray 100. In higher volume operations, the partially enclosed load stack is delivered to a second, downstream hooder 206. The use of a second hooder 206 allows the process to continue in a forward direction without disrupting the flow of trays 100 through the system. As the second hooder 206 is completing the wrapping process, the first hooder 202 can be stretching film 116 over a subsequent load stack.

The tray 100 is also designed to permit the efficient removal of the load stack 112 from the tray 100. In particular, the tray 100 permits the removal of the bags 112 with mechanical or robotic systems. The bags 112 can be removed from the tray 100 either by utilizing a robot to remove a single bag 112 from the tray 100, or by bulk dumping of multiple bags 112 by tilting the tray 100. In yet another embodiment, the tray 100 can be unloaded into downstream systems by reversing of the top and bottom of the tray 100 at an angle sufficient to cause all the bags 100 to fall out of the tray 100 and into a receiving hopper. Ideally, the tilting equipment maintains a grasp on the tray to prevent the tray 100 from also falling into the hopper. In other applications, it may be possible to place the entire loaded tray into a hopper for downstream processing. If, for example, the tray 100 is used to carry bags of pelletized plastic and the tray is manufactured from the same plastic, it may be possible to place the entire loaded tray into a hopper or grinder for downstream processing.

Figure 9:
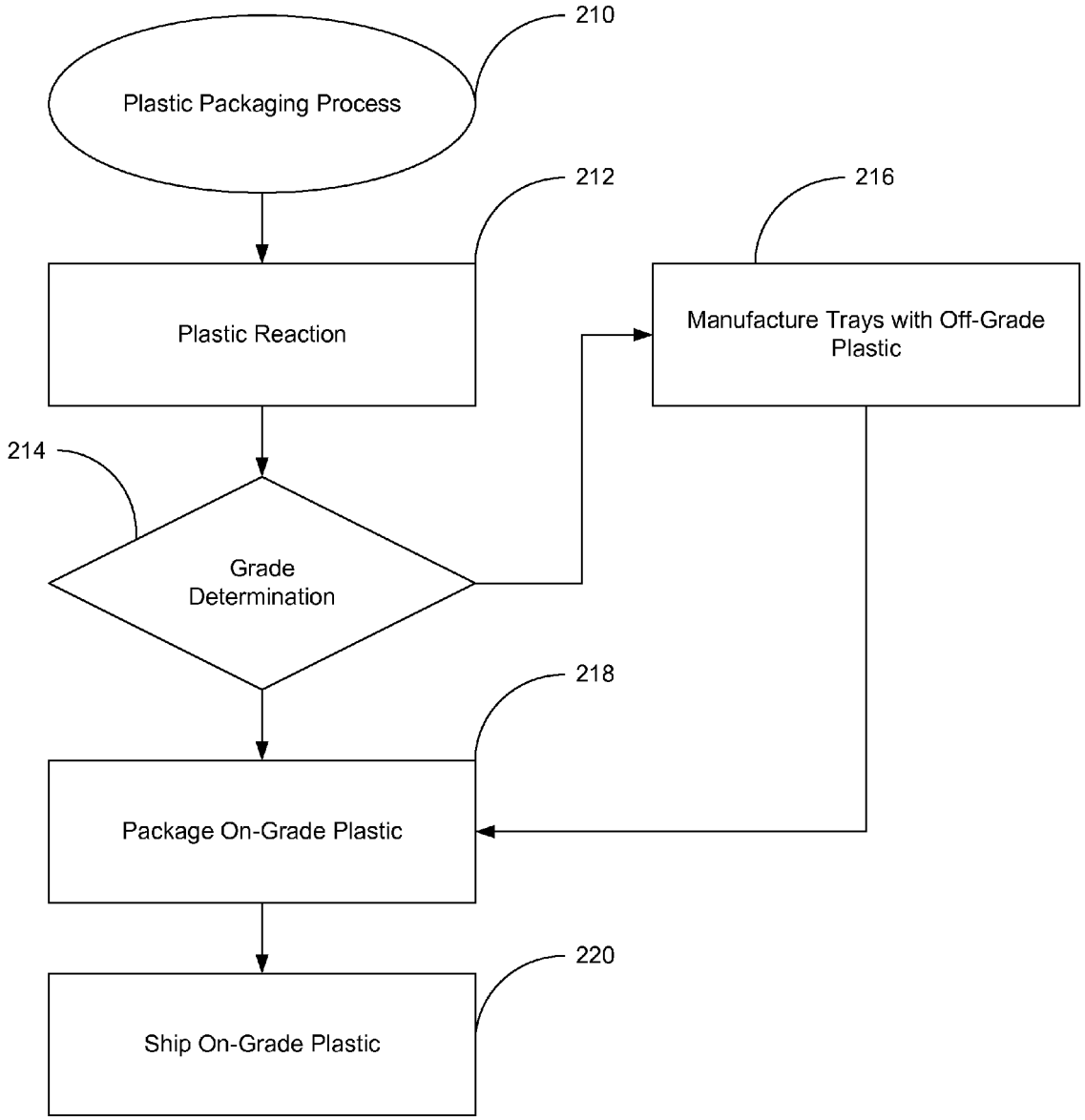
FIG. 9 is a process flow diagram depicting a preferred method of sourcing the load tray of FIG. 1 in a high-volume manufacturing and packaging operation.

Turning to FIG. 9, depicted therein process for packaging granular plastic resin 210. At step 212, a reactor produces granulized plastic resin at a pre-selected grade. Suitable plastics include, for example, high density polyethylene (HDPE), polyethylene (PE), polypropylene (PP), acrylonitrile butadiene styrene (ABS), polycarbonate (PC), polyvinyl chloride (PVC) and high impact polystyrene (HIPS). It will be understood that the material of construction of the tray 100 may vary depending on the intended application, and the materials of construction listed herein are not exclusive of the types of plastics or blends of plastic types that may be used in the construction of the tray 100. At step 214, a decision is made about whether the plastic meets the pre-selected grade requirements. Off-grade plastic is diverted to a tray manufacturing facility and trays 100 are manufactured at step 216 using the off-grade plastic. At step 218, the trays 100 are used to support load stacks of on-grade plastic from the reactor. At step 220, the on-grade plastic is shipped using trays manufactured from off-grade plastic. In this way, the plastic production facility and tray manufacturing facility cooperate to reduce waste plastic and lower the cost of manufacturing the trays 100.

The trays 100 are well suited to handle bags 112 of a wide variety of dimensions, package elasticity, tensile strength, puncture resistance and constructed from plastic film, paper or other materials of construction. The trays 100 are particularly well adapted to handle loads of liquid or solid product packaged in woven plastic bags that exhibit high strength and relatively low elasticity. Although the construction and use of the trays 100 has been described in the instant application as useful for handling bags 112, it will be understood that the trays 100 may also be adapted to handle loads of solid or liquid product packaged in drums, totes and pails, all of varying width, height, length and weight, and also discrete products not separately packaged.

Turning now to FIGS. 10-13, shown therein are perspective, front-side, top and right-side views, respectively of an alternate preferred embodiment of a load-handling tray 300.

The tray 300 includes a floor 302, side walls 303, a top 304, and a lip 306. The tray further includes bolsters 308 along at least one pair of opposing side walls 303 that extend from the floor 302 to the top 304. In the presently preferred embodiment, the tray 300 is rectangular and includes two bolsters 308 along the long side of the tray 300 and no bolsters along the short side of the tray 300. The tray 300 further includes rounded corners 310 at the junction between sides of the tray 300.

Figure 10:
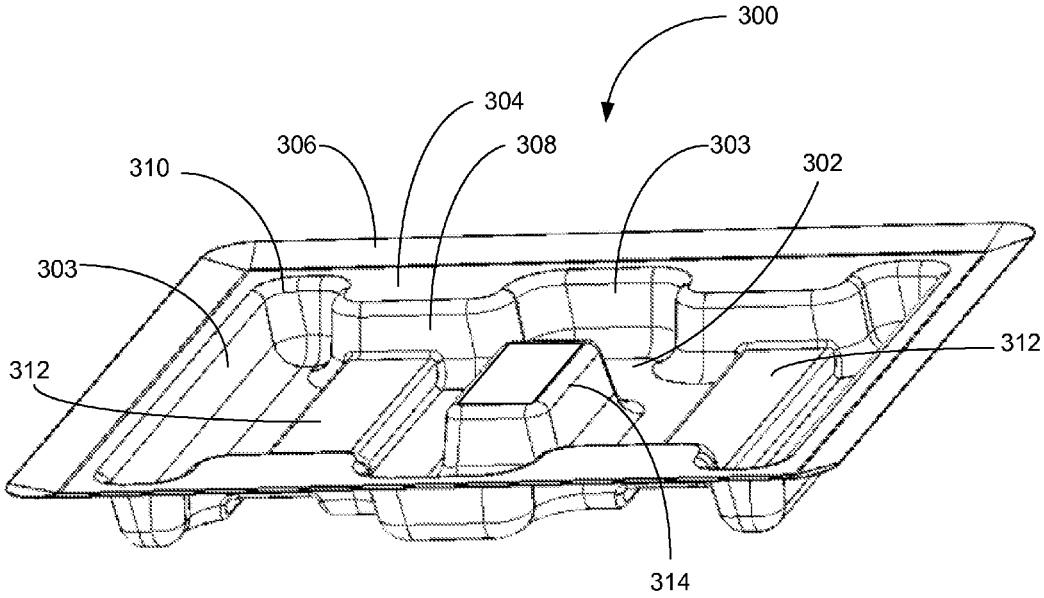
FIG. 10 is a top perspective view of a first alternate embodiment of the load tray.
Figure 11:
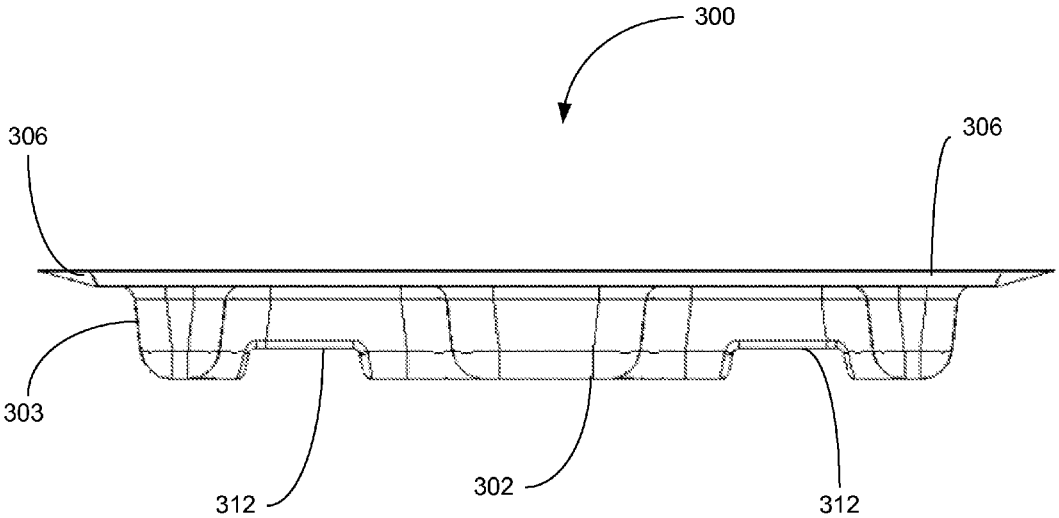
FIG. 11 is a front side view of the first alternate embodiment of FIG. 10.
Figure 12:
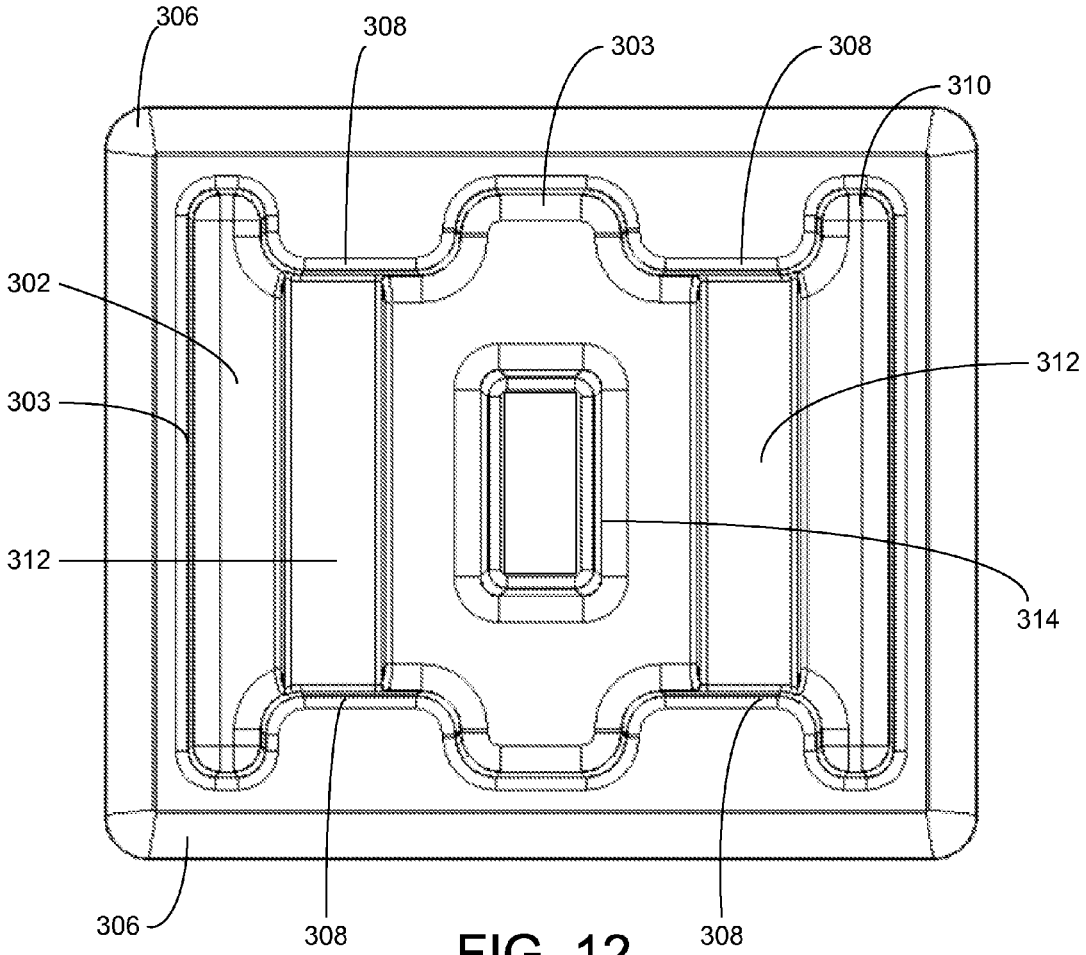
FIG. 12 is a top view of the first alternate embodiment of FIG. 10.
Figure 13:
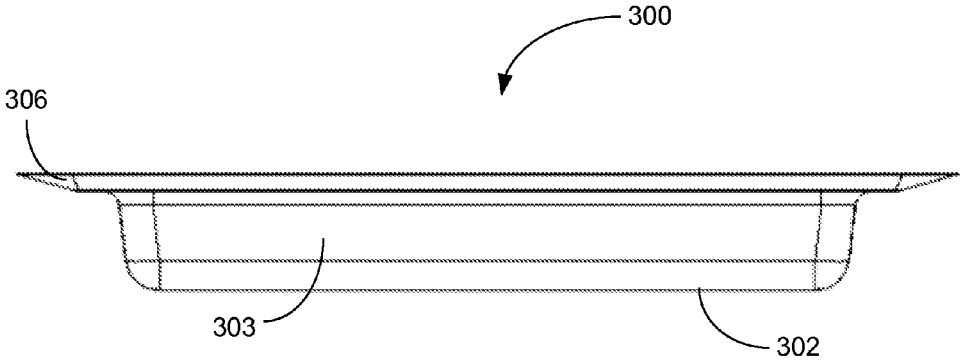
FIG. 13 is a left side view of the first alternate embodiment of FIG. 10.

The alternate embodiment depicted in FIG. 10 further includes raised fork tunnels 312 that extend across the floor 302 between the bolsters 308. The fork tunnels 312 are sized and configured to permit the forks of a forklift to pass through the fork tunnels 312. Thus unlike the embodiment depicted in FIG. 1, in which the forks of a forklift are intended to be placed under the lip 106, the embodiment depicted in FIG. 10 allows the forklift to lift the tray 300 under the lip 306 or through the fork tunnels 312.

The embodiment depicted in FIG. 10 also includes a pillar 314. The pillar 314 preferably extends from the floor 302 near the center of the tray 300. The pillar 314 is helpful in spacing the bags 112 at the lowest level in the load stack. The pillar 314 may be used as an alternative to the additional bolsters 308 disposed on the short sides of the tray 300. The pillar 314 also provides additional support to the center of the load stack to reduce slumping or instability in the load stack. In this way, the lowest level of the bags 112*a* and the pillar 314 together provide a stable base upon which the upper levels of the load stack are supported.

Figure 14:
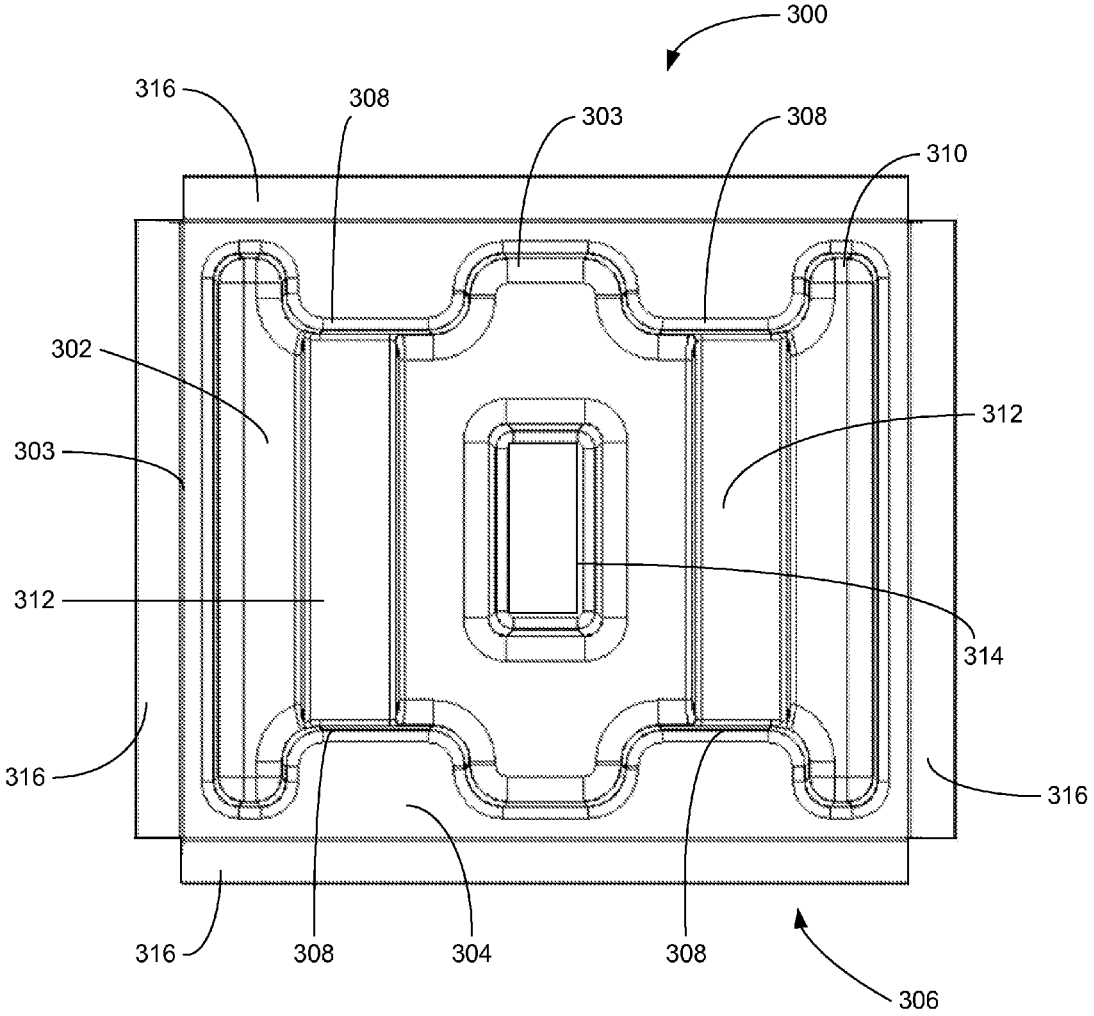
FIG. 14 is a top view of a second alternate embodiment of the load tray.

Turning to FIG. 14, shown therein is a top view of the tray constructed in accordance with yet another alternate embodiment. In the alternate embodiment depicted in FIG. 14, the lip 306 includes four distinct rails 316 that are each connected to the top 304 of the tray 300. Unlike the unitary lip 306, the rails 316 are not interconnected. During the wrapping process, the rails 316 are more easily and completely deformed into a position in contact with the load stack as the hooder 202 applies the film 116 around the tray 300 and load stack 112. The use of the rails 316 may also reduce the risk of tearing or puncturing the film 116 as it is applied by the hooder 202.

Unless stated to the contrary, implicit from the context, or customary in the art, all parts and percents are based on weight, and all test methods are current as of the filing date of this disclosure.

The term "pillar," as used herein, refers to a projection rising from the base floor of the tray, towards the top of the tray, and where this projection has two surface areas and a height.

The term "bolster," as used herein, refers to a projection extending from a side wall of the tray, towards the center of the tray, and where the bolster has two surface areas and a height.

The term "ridge," as used herein, refers to a projection extending from the floor of the tray, towards the top of the tray, and where the ridge has two surface areas and a height, and where the outer height of the ridge is less than the outer height of a pillar, when present.

The term "uniform thickness," as used herein refers to thickness tolerances less than 20%, preferably less than 10%, of the average thickness of a tray, and where the average thickness of the tray is determined by a continuous measurement of the tray thickness. The continuous measurement of the tray thickness can be measured, for example, by commercial equipment available from, for example, Mitutoyo U.S.A. or Keyence America.

The term phrase "substantially horizontal position," as used herein in reference to the deployable lip, refers to a position of the lip that is within, and including, ±10 degree, relative to the horizontal position of the lip.

The term phrase "substantially vertical position," as used herein in reference to the deployable lip, refers to a position of the lip that is within, and including, ±10 degree, relative to the vertical (90 degree) position of the extended lip.

The term "stabilized load tray," as used herein, refers to a tray (for example, as described herein) used to support a load stack.

The term "load stack," as used herein, refers to one or more items of packaged goods or to one or more discrete products not packaged together. Such goods and products are supported by the trays, as described herein.

The term "horizontal floor," as used herein, refers to the base floor of the tray.

The term "vertical side walls," as used herein, refers to the side walls of the tray. Such side walls typically contain a curvature in one or more locations along the wall.

The term "composition," as used herein, includes a mixture of materials which comprise the composition, as well as reaction products and decomposition products formed from the materials of the composition.

The term "polymer," as used herein, refers to a polymeric compound prepared by polymerizing monomers, whether of the same or a different type. The generic term polymer thus embraces the term homopolymer (employed to refer to polymers prepared from only one type of monomer, with the understanding that trace amounts of impurities can be incorporated into the polymer structure) and the term interpolymer as defined hereinafter. Trace amounts of impurities, such as catalyst residues, may be incorporated into and/or within the polymer.

The term "interpolymer," as used herein, refers to polymers prepared by the polymerization of at least two different types of monomers. The generic term interpolymer thus includes copolymers (two monomer types) and polymers prepared from more than two different types of monomers.

The term, "olefin-based polymer," as used herein, refers to a polymer that comprises, in polymerized form, a majority amount of olefin monomer, for example ethylene or propylene (based on the weight of the polymer), and optionally may comprise one or more comonomers.

The term, "ethylene-based polymer," as used herein, refers to a polymer that comprises, in polymerized form, a majority amount of ethylene monomer (based on the weight of the polymer), and optionally may comprise one or more comonomers.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound whether polymeric or otherwise, unless stated to the contrary. In contrast, the term, "consisting essentially of" excludes from the scope of any succeeding recitation any other component, step or procedure, excepting those that are not essential to materiality or operability. The term "consisting of" excludes any component, step or procedure not specifically delineated or listed.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein and in the associated drawings and appended claims.

The invention claimed is:

1. A stabilized load tray for supporting a load stack, the stabilized load tray comprising:

a molded unitary body, wherein the molded unitary body further comprises:

a horizontal floor, wherein the horizontal floor is the lowermost portion of the stabilized load tray and configured to support a portion of the load stack;

vertical side walls molded to and extending upward from the floor;

a top molded to an upper end of the side walls, wherein the top is substantially parallel to the horizontal floor;

a plurality of bolsters, wherein each of the plurality of bolsters extends from the side walls and horizontal floor to the top; and a deployable lip molded to an outer edge of the top, wherein the deployable lip can be folded from a substantially horizontal position to a substantially vertical position adjacent the load stack.

2. The stabilized load tray of claim 1, further comprising a pillar extending upward from the horizontal floor.

3. The stabilized load tray of claim 1, wherein the deployable lip comprises a unitary lip that extends around the periphery of the top of the stabilized load tray.

4. The stabilized load tray of claim 1, wherein the deployable lip comprises a series of independent rails connected to the top of the stabilized load tray.

5. The stabilized load tray of claim 1, wherein the inner length of the tray (ILT) is greater than, or equal to, the inner width of the tray (IWT), and wherein the inner depth of the tray (IDT) is less than 0.4×ILT; and wherein the lip extends from at least two side walls of the tray, and wherein the width of the lip (Wlip) is greater than, or equal to, 0.2×IDT; and wherein the tray is formed from a composition comprising at least one polymer.

6. The stabilized load tray of claim 1, wherein the inner surface area of the floor is greater than, or equal to, 5,000 $cm^2$.

7. The stabilized load tray of claim 1, wherein the tray has a uniform thickness that is greater than, or equal to, 0.00025×Wlip.

8. The stabilized load tray of claim 2, wherein the outer height of the pillar (OHpillar) is from 0.80 to 1.20 times the IDT.

9. The stabilized load tray of claim 2, wherein the pillar is located midway along the ILT.

10. The stabilized load tray of claim 2, wherein the pillar is located midway along the IWT.

11. The stabilized load tray of claim 2, wherein the outer length of the pillar (OLpillar) is greater than, or equal to, 0.20×IWT.

12. The stabilized load tray of claim 2, wherein the outer width of the pillar (OWpillar) is greater than, or equal to, 0.10×ILT.

13. The stabilized load tray of claim 2, wherein the length of the pillar runs parallel to the width of the tray.

14. The stabilized load tray of claim 1, wherein the tray comprises at least two bolsters.

15. The stabilized load tray of claim 14, wherein the two bolsters are located at opposite side walls of the tray.

16. The stabilized load tray of claim 14, wherein each bolster extends at a distance of greater than, or equal to, 0.035×IWT, from a side wall.

17. The stabilized load tray of claim 14, wherein the outer height of each bolster is equal to the IDT.

18. The stabilized load tray of claim 1, wherein the lip is bent upward at an angle greater than, or equal to, 0.5 degree, relative to the unextended position of the lip.

19. The stabilized load tray of claim 18, wherein the lip is bent at a distance from 0.40 to 0.60 times the Wlip, measured from the outer edge of the lip.

20. The stabilized load tray of claim 2, wherein the tray comprises at least two ridges located at opposite ends of the floor, and wherein each ridge independently comprises the following dimensions: outer length (OLridge), outer width (OWridge) and outer height (OHridge); and wherein the OHridge is less than, or equal to, 0.5×IDT.

21. The stabilized load tray of claim 20, wherein the OWridge of each ridge is independently equal to the outer width of the pillar (OWpillar).

22. The stabilized load tray of claim 20, wherein the OLridge of each ridge runs parallel to the IWT.

23. The stabilized load tray of claim 20, wherein the OHridge of each ridge is independently less than, or equal to, 0.20 IDT.

24. The tray of claim 5, wherein the polymer is an olefin-based polymer.

* * * * *